US008042508B2

(12) United States Patent
Kumagai et al.

(10) Patent No.: US 8,042,508 B2
(45) Date of Patent: Oct. 25, 2011

(54) CAMSHAFT SUPPORT STRUCTURE FOR INTERNAL COMBUSTION ENGINE

(75) Inventors: Atsunori Kumagai, Sunto-gun (JP); Tetsushi Suzuki, Mishima (JP); Takanori Sasaki, Susono (JP); Shoichi Tateyama, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 501 days.

(21) Appl. No.: 12/087,475

(22) PCT Filed: Jan. 18, 2007

(86) PCT No.: PCT/IB2007/000127

§ 371 (c)(1),
(2), (4) Date: Jul. 8, 2008

(87) PCT Pub. No.: WO2007/083225

PCT Pub. Date: Jul. 26, 2007

(65) Prior Publication Data

US 2009/0000591 A1 Jan. 1, 2009

(30) Foreign Application Priority Data

Jan. 19, 2006 (JP) ..... 2006-010949
Jan. 19, 2006 (JP) ..... 2006-010950

(51) Int. Cl.
*F01M 9/10* (2006.01)

(52) U.S. Cl. ..... 123/90.38; 123/90.16; 123/90.39; 123/193.5

(58) Field of Classification Search ..... 123/90.27, 123/90.31, 90.16, 90.38, 90.39, 193.3, 193.5
See application file for complete search history.

(56) References Cited

U.S. PATENT DOCUMENTS

| | | | |
|---|---|---|---|
| 3,422,803 | A | 1/1969 | Stivender |
| 4,823,747 | A | 4/1989 | Wagner et al. |
| 5,161,495 | A | 11/1992 | Saito |
| 5,458,099 | A | 10/1995 | Koller et al. |
| 6,550,432 | B2 | 4/2003 | Takahashi et al. |
| 2002/0185094 | A1 | 12/2002 | Yoon |
| 2007/0163523 | A1 | 7/2007 | Miyazato et al. |

FOREIGN PATENT DOCUMENTS

| | | |
|---|---|---|
| DE | 3641 129 C1 | 7/1987 |
| DE | 100 41 975 A1 | 8/2000 |
| EP | 0635631 A1 | 1/1995 |
| GB | 1 201 558 | 8/1970 |
| JP | A 60-187706 | 9/1985 |

(Continued)

OTHER PUBLICATIONS

European Office Action issued in European Patent Application No. EP 07 700 499.2 on Jun. 23, 2009.

(Continued)

*Primary Examiner* — Ching Chang
(74) *Attorney, Agent, or Firm* — Oliff & Berridge, PLC

(57) ABSTRACT

A cylinder head of an internal combustion engine is fitted with rocker arms. Camshafts are disposed so that the rocker arms and cams will be brought into contact with each other. The camshafts are rotatably supported by lower bearings, which supports the camshafts from below, and by upper bearings integrated with a head cover. The head cover is provided with visual observation windows that make it possible to see valve system parts through the head cover. A visual observation window covers for covering the visual observation windows are fixed to the head cover.

15 Claims, 3 Drawing Sheets

FOREIGN PATENT DOCUMENTS

| | | |
|---|---|---|
| JP | A 60-195320 | 10/1985 |
| JP | A-01-155011 | 6/1989 |
| JP | A 2-248606 | 10/1990 |
| JP | U 2-147857 | 12/1990 |
| JP | U 3-97505 | 10/1991 |
| JP | A 4-95643 | 3/1992 |
| JP | U 6-22551 | 3/1994 |
| JP | U 6-83912 | 12/1994 |
| JP | A 7-166956 | 6/1995 |
| JP | A 11-173210 | 6/1999 |
| JP | A 11-247710 | 9/1999 |
| JP | A-2003-254024 | 9/2003 |
| JP | EP 1 441 122 A1 | 7/2004 |
| JP | A 2005-163703 | 6/2005 |
| JP | A 2006-504894 | 2/2006 |
| WO | WO 2004/040115 A1 | 5/2004 |

OTHER PUBLICATIONS

Notice of Allowance issued in U.S. Appl. No. 11/886,878 on Mar. 15, 2010.

Jan. 25, 2011 Office Action issued in U.S. Appl. No. 12/087,650.

CAMSHAFT SUPPORT STRUCTURE FOR INTERNAL COMBUSTION ENGINE

BACKGROUND OF THE INVENTION

1. Field of the Invention

The present invention relates to a camshaft support structure for an internal combustion engine, and, in particular, to a camshaft support structure suitable for supporting camshafts in an internal combustion engine that is mounted on a vehicle.

2. Description of the Related Art

As described in Japanese Patent Application Publication No. 7-166956 (JP-A-7-166956), for example, a camshaft support structure in which upper bearings are integrated with a head cover is available. This conventional support structure is provided with a lower bearing that is paired with each upper bearing. The upper bearing and the lower bearing are both formed so as to have semicircular concave surfaces, and support camshafts by being fixed in a state where the upper and lower bearings are opposed to each other.

Cams for opening intake valves or exhaust valves are fixed to the camshaft. The intake valves and the exhaust valves are opened by being pushed by cam noses as the camshafts rotate. When the cam nose pushes and opens the intake valve or the exhaust valve, the reaction force is applied to the camshaft. The reaction force acts in a direction such that the camshaft is pressed against the upper bearings. For this reason, the upper bearings require higher rigidity than the lower bearings.

With the above conventional support structure, it is possible to give high rigidity to the upper bearings by integrating them with the head cover. Such rigidity makes it possible to support the camshaft with high accuracy owing to the sufficiently high rigidity.

In order to obtain the above conventional support structure, the assembly procedure as described below is necessarily taken. Specifically, in order to realize this structure, a cylinder head is first fitted with the intake valves and the exhaust valves. Next, rocker arms are placed on the intake valves and the exhaust valves. The rocker arms are the members for transmitting the pushing force of the cams to valve elements.

In another step than the above step, camshafts are fitted to the head cover. That is, in a state where the camshafts are placed on the upper bearings in the head cover, the lower bearings are fixed to the upper bearings. As a result, the camshafts are rotatably held by the head cover.

After the above step, the head cover is fixed to the cylinder head with the camshafts held by the head cover. In this step, it is necessary that the camshaft is disposed so that the rocker arms are properly sandwiched between the cams and the valve elements.

However, normally the rocker arms are merely put on the valve elements until they are held down by the camshafts. For this reason, the rocker arms are prone to fall off when the head cover holding the camshafts is fixed to the cylinder head. In order to prevent such falling off, it is preferable to be able to see the rocker arms when the head cover is fixed to the cylinder head. Moreover, in order to check the condition of the valve system, it is preferable to be able to easily see the condition of the rocker arms even after the internal combustion engine has been properly assembled.

However, with regard to the above conventional support structure, when the head cover is fixed to the cylinder head, it is very difficult to see the rocker arms that are located inside the head cover. In addition, it is necessary to remove the head cover in order to see the condition of the rocker arms; and it is impossible to see the rocker arms in a state where the assembly is completed. In this respect, the above conventional support structure is not always preferable from the viewpoint of productivity and easiness of maintenance/inspection.

The valve train of the internal combustion engine, especially the parts around the cams are important elements to allow the internal combustion engine to operate properly. For this reason, it is preferable to be able to check whether the cams are properly installed, or whether foreign matter is caught around the cams, for example, through visual inspection at the time of the maintenance/inspection of the internal combustion engine.

However, because the upper bearings are integrated with the head cover in the above conventional support structure, it is impossible to remove the head cover, leaving the camshafts properly held in the internal combustion engine. Accordingly, if this support structure is used, it is impossible to see the cams, leaving the camshafts held. In this respect, the above conventional support structure is not always ideal from the viewpoint of productivity in manufacturing the internal combustion engine, and the workability of the maintenance/inspection.

SUMMARY OF THE INVENTION

The present invention provides a camshaft support structure for an internal combustion engine that makes it possible to see the valve system parts that are located inside a head cover, while a structure is adopted in which upper bearings are integrated with the head cover.

A first aspect of the present invention is a camshaft support structure that includes: a cylinder head; a camshaft provided with a cam for driving a valve element; a lower bearing that supports the camshaft on the cylinder head side; and a head cover integrally provided with an upper bearing that supports the camshaft on the side opposite to the lower bearing, wherein the head cover is provided with a visual observation window that makes it possible to see a valve system part in a state where the head cover is fixed to the cylinder head.

According to the first aspect, it is possible to give sufficiently high rigidity to the upper bearing by integrating the upper bearing with the head cover, which seals the inside of the internal combustion engine. In addition, the head cover is provided with the visual observation window, so that it is possible to see the valve system parts through the head cover in a state where the head cover covers the cylinder head.

A second aspect of the present invention is similar to the first aspect, except that the camshaft support structure further includes a rocker arm that is installed in the cylinder head, wherein the head cover is provided with a visual observation window that makes it possible to see the rocker arm in a state where the head cover is fixed to the cylinder head.

According to the second aspect, it is possible to give sufficiently high rigidity to the upper bearing by integrating the upper bearing with the head cover, which seals the inside of the internal combustion engine. In addition, the head cover is provided with the visual observation window, so that it is possible to see the rocker arm through the head cover in a state where the head cover covers the cylinder head.

A third aspect of the present invention is similar to the first and second aspects, except that the camshafts include an intake camshaft provided with an intake cam for driving an intake valve, and an exhaust camshaft provided with an exhaust cam for driving an exhaust valve; the rocker arms include an intake rocker arm that is in contact with the intake cam, and an exhaust rocker arm that is in contact with the exhaust cam; the visual observation windows include an intake-side visual observation window that makes it possible to see the intake rocker arm and an exhaust-side visual observation window that makes it possible to see the exhaust rocker arm; and the intake-side visual observation window and the exhaust-side visual observation window are provided so that it is possible to see both the intake rocker arm through the intake-side visual observation window and the exhaust rocker arm through the exhaust-side visual observation window when the internal combustion engine is viewed from a certain direction.

According to the third aspect, the head cover is provided with the intake-side visual observation window and the exhaust-side visual observation window, so that it is possible to see both the intake rocker arm and the exhaust rocker arm from a certain direction. Thus, the third aspect makes it possible to improve the efficiency of the assembly work and the maintenance/inspection performed by a single worker.

A fourth aspect of the present invention is similar to the first aspect, except that the head cover is provided with a visual observation window that makes it possible to see the cam in a state where the camshaft is held in the upper bearing.

According to the fourth aspect, it is possible to give sufficiently high rigidity to the upper bearing by integrating the upper bearing with the head cover, which seals the inside of the internal combustion engine. In addition, the head cover is provided with the visual observation window, so that it is possible to see the cam through the head cover in a state where the head cover covers the cylinder head.

A fifth aspect of the present invention is similar to the first and fourth aspects, except that the camshafts include an intake camshaft provided with an intake cam for driving an intake valve, and an exhaust camshaft provided with an exhaust cam for driving an exhaust valve; the visual observation windows include an intake-side visual observation window that makes it possible to see the intake cam, and an exhaust-side visual observation window that makes it possible to see the exhaust cam; and the intake-side visual observation window and the exhaust-side visual observation window are provided so that it is possible to see both the intake cam through the intake-side visual observation window and the exhaust cam through the exhaust-side visual observation window when the internal combustion engine is viewed from a certain direction.

According to the fifth aspect, the head cover is provided with the intake-side visual observation window and the exhaust-side visual observation window, so that it is possible to see both the intake cam and the exhaust cam from a single viewpoint. Thus, the fifth aspect makes it possible to improve the efficiency of the assembly work and the maintenance/inspection performed by a single worker.

A sixth aspect of the present invention is similar to the fourth and fifth aspects, except that the visual observation window is provided so that it is possible to see all the cams with which the internal combustion engine is provided.

According to the sixth aspect, the visual observation window is provided so that it is possible to see all the cams. Thus, a worker can easily check whether all of the cams are in a proper state through the visual observation window.

A seventh aspect of the present invention is similar to the first to sixth aspects, except that the head cover is provided with a plurality of the upper bearings that are arranged in the axial direction of the camshaft, each of the upper bearings has a semicircular portion for holding a journal portion of the camshaft, and at least part of the plurality of upper bearings are such that at least the top portion of the semicircular portion of the upper bearing is continuous with the top portion of the semicircular portion of an adjacent upper bearing.

According to the seventh aspect, at least part of the upper bearings are such that the top portion of the semicircular portion of the upper bearing is continuous with the top portion of the semicircular portion of an adjacent upper bearing. The top portion of the semicircular portion is the portion at which the reaction force exerted on the camshaft is concentrated, that is, the portion of the upper bearing to which the greatest force is applied. For this reason, if these portions are made continuous with each other, it is possible to efficiently increase the rigidity of the upper bearing. Thus, the seventh aspect makes it possible to efficiently give high rigidity to the upper bearing, while the visual observation window is provided.

A eighth aspect of the present invention is similar to the first to seventh aspects, except that all the upper bearings are such that at least the top portion of the semicircular portion of the upper bearing is continuous with the top portion of the semicircular portion of every adjacent upper bearing.

According to the eighth aspect of the present invention, all the upper bearings are such that the top portions of the semicircular portions of adjacent upper bearings are continuous with each other. Thus, the eighth aspect makes it possible to efficiently give high rigidity to all the upper bearings, while the visual observation window is provided.

An ninth aspect of the present invention is similar to the first to eighth aspects, except that the camshaft support structure further includes a visual observation window cover, separate from the head cover, that covers the visual observation window.

According to the ninth aspect, the camshaft support structure includes the visual observation window cover for covering the visual observation window, so that it is possible to prevent blowby gas and oil from being splashed out of the internal combustion engine through the visual observation window.

A tenth aspect of the present invention is similar to the ninth aspect, except that a separation chamber for separating oil and gas that are discharged through the visual observation window is formed inside the visual observation window cover.

According to the tenth aspect, it is possible to separate the function of the separation chamber from the head cover by using the inside of the visual observation window cover as a separation chamber. Thus, with the tenth aspect, it is possible to simplify the structure of the head cover.

A eleventh aspect of the present invention is similar to the ninth and tenth aspect, except that the visual observation window cover is made of a lightweight material that is lighter than the material of the cylinder head.

According to the eleventh aspect, it is possible to reduce the weight of, and lower the center of gravity of the internal combustion engine by making the visual observation window cover of a lightweight material.

An twelfth aspect of the present invention is similar to the ninth to eleventh aspects, except that the camshaft support structure further includes an oil shower, disposed between the upper bearing and the visual observation window cover, that sprays oil on the cam or the rocker arm through the visual observation window.

According to the twelfth aspect, the oil shower for spraying oil on the cam or the rocker arm is disposed between the upper bearing and the visual observation window cover. Such a disposition makes it possible to perform the maintenance/inspection of the oil shower immediately after removing the visual observation window cover. Thus, the twelfth aspect makes it possible to achieve excellent workability of the maintenance/inspection of the oil shower.

A thirteenth aspect of the present invention is similar to the ninth to twelfth aspects, except that the camshaft support structure further includes: an oil filler used to supply oil to the internal combustion engine; and an oil splash prevention structure for blocking the oil that splashes from an inner area in the internal combustion engine toward the oil filler, wherein the oil filler and the oil splash prevention structure are provided in the visual observation window cover.

According to the thirteenth aspect, the visual observation window cover is provided with the oil filler and the oil splash prevention structure. The requirements of the oil filler to smoothly supply oil to the internal combustion engine, and the requirements of the oil splash prevention structure to well prevent the oil splash vary depending on the type of the internal combustion engine, the position in which the internal combustion engine is mounted on the vehicle, etc. According to the thirteenth aspect, all what is needed to achieve a desired object is to adapt the visual observation window cover to the variation. Thus, with the thirteenth aspect, it is possible to enhance the commonality of components, such as the head cover, except the visual observation window cover.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

First Embodiment (Structure of the First Embodiment)

Basic Structure

Figure 1:
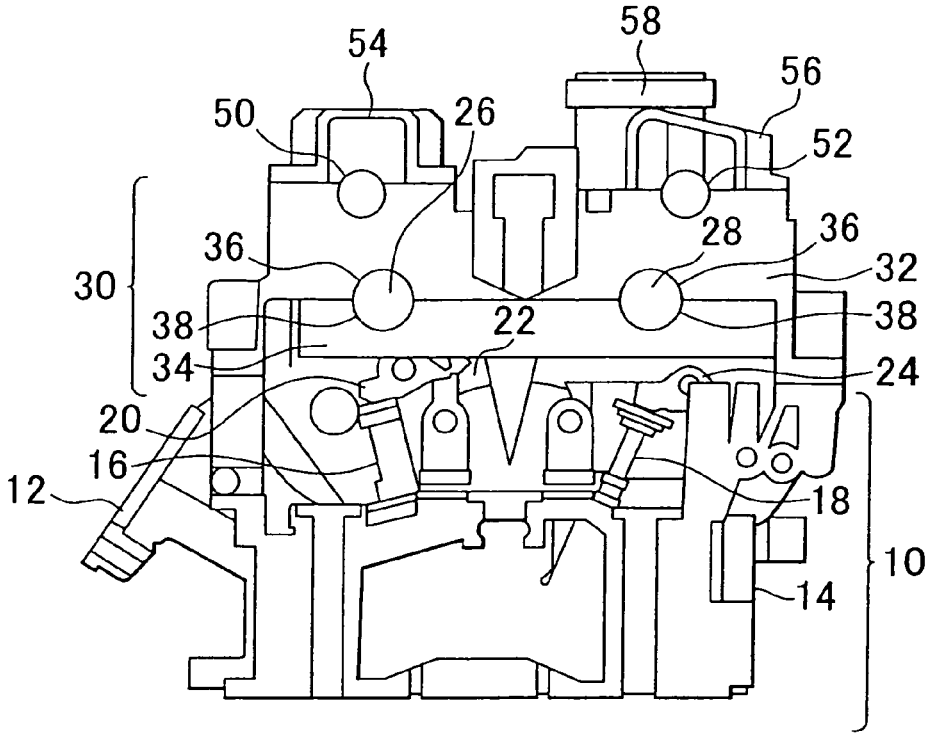
FIG. 1 is a diagram for explaining a camshaft support structure of a first embodiment of the present invention.

FIG. 1 is a diagram for explaining a camshaft support structure of a first embodiment of the present invention. The support structure of this embodiment includes a cylinder head 10 of an internal combustion engine. The cylinder head 10 is made of aluminum or cast iron, and is provided with intake ports 12 and exhaust ports 14.

The internal combustion engine shown in FIG. 1 is a multi-cylinder engine including a plurality of cylinders, each cylinder being provided with two intake ports 12 and two exhaust ports 14. FIG. 1 is a sectional view obtained by cutting the internal combustion engine so that one of the cylinders is illustrated. The internal combustion engine shown in FIG. 1 includes the plurality of cylinders, the plurality of intake ports 12, and the plurality of exhaust ports 14, which are arranged in an in-line arrangement in the direction perpendicular to the plane of the sheet.

As shown in FIG. 1, the cylinder head 10 is provided with intake valves 16 for opening and closing the intake ports 12, and exhaust valves 18 for opening and closing the exhaust ports 14. The intake valves 16 and the exhaust valves 18 are brought into an open state when they are moved downward in FIG. 1. These valves are urged in the direction to close the valves, that is, upward in FIG. 1, by valve springs (not shown).

An upper portion of the intake valve 16 is in contact with one end of an intake rocker arm 20. The other end of the intake rocker arm 20 is in contact with the upper end of a lash adjuster 22. Specifically, the intake rocker arm 20 is placed on the intake valve 16 and the lash adjuster 22.

Similarly, the upper end of the exhaust valve 18 is in contact with one end of an exhaust rocker arm 24. The other end of the exhaust rocker arm 24 is placed on an exhaust-side lash adjuster (not shown). Specifically, the exhaust rocker arm 24 is placed on the exhaust-side lash adjuster and the exhaust valve 18.

The internal combustion engine shown in FIG. 1 includes an intake camshaft 26 for driving the intake valves 16, and an exhaust camshaft 28 for driving the exhaust valves 18. The intake camshaft 26 is disposed so as to extend over all cylinders that are arranged in an in-line arrangement, and is provided with intake cams corresponding to the respective intake valves 16, more specifically, the intake cams (not shown) that are in contact with the respective intake rocker arms 20 that are placed on the respective intake valves 16. Similarly, the exhaust camshaft 28 is provided with exhaust cams (not shown) that are in contact with the respective exhaust rocker arms 24.

The intake cams with which the intake camshaft 26 is provided restrict the positions of the intake rocker arms 20 from above. The exhaust cams with which the exhaust camshaft 28 is provided restrict the positions of the exhaust rocker arms 24 from above. As a result, the intake rocker arm 20 is sandwiched between the intake cam, which is located above the intake rocker arm 20, and the intake valve 16 and the lash adjuster 22, which are located below the intake rocker arm 20. Similarly, the exhaust rocker arm 24 is sandwiched between the exhaust cam, and the exhaust valve 18 and the exhaust-side lash adjuster.

When the intake camshaft 26 rotates in this situation, pushing force is periodically applied to the intake rocker arms 20 by the intake cams. According to the occurrence and the vanishment of the pushing force, the intake rocker arm 20 swings about the end portion thereof that is supported by the lash adjuster 22 so as to open and close the intake valves 16. As a result, the intake valves 16 are opened and closed in synchronization with the rotation of the intake camshaft 26. A similar mechanism causes the exhaust valves 18 to open and close in synchronization with the rotation of the exhaust camshaft 28. Each of the intake rocker arms 20, the intake cams, the exhaust rocker arms 24, the exhaust cams serves as one of the parts of the valve system that drives the intake valves 16 and the exhaust valves 18.

A head cover 30 is fixed to the top of the cylinder head 10. The head cover 30 is made of magnesium, which is lighter than aluminum and cast iron. The head cover 30 is integrally provided with upper bearings 32. More specifically, a plurality of the upper bearings 32 are provided in the head cover 30 so that the upper bearings 32 are positioned at respective boundary portions between the cylinders.

A lower bearing 34 is fixed to each upper bearing 32. As in the case of the head cover 30 (accordingly, as in the case of the upper bearings 32), the lower bearing 34 is made of magnesium. Semicircular portions 36 and semicircular portions 38, which are paired with each other, are provided in the upper bearings 32 and the lower bearing 34. The intake camshaft 26 and the exhaust camshaft 28 are rotatably held between the semicircular portions 36 and semicircular portions 38.

Structure of Head Cover

Figure 2:
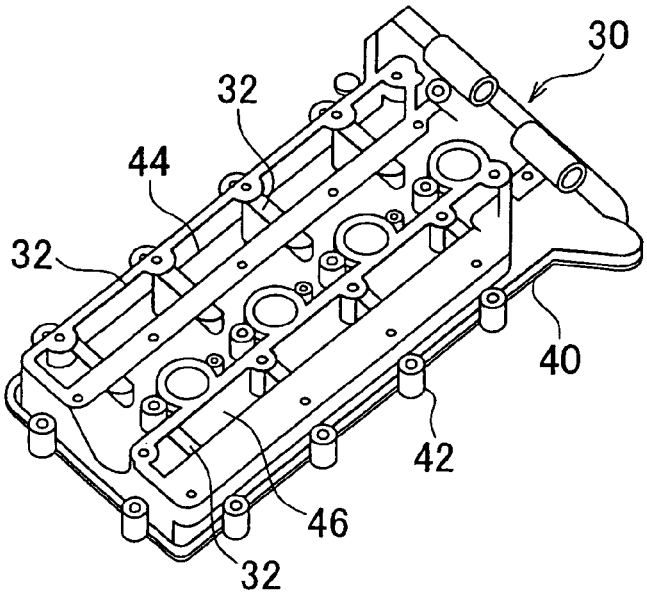
FIG. 2 is a perspective view of a head cover shown in FIG. 1.

FIG. 2 is a perspective view of the head cover 30. The support structure of this embodiment has part of the characteristic feature in the structure of the head cover 30. The characteristic portion will be described below.

The head cover 30 is provided with a seal portion along the entire periphery to isolate the inside of the internal combustion engine from the outside thereof. Specifically, the head cover 30 is provided with a flange portion 40 along the entire periphery. A plurality of bolt holes 42 are provided in the flange portion 40. The head cover 30 is fastened to the cylinder head 10 with bolts (not shown) that are passed through the bolt holes 42. The flange portion 40 is fitted with a seal member. Thus, by fastening the head cover 30 to the cylinder head 10, it is possible to provide a sufficient seal between the flange portion 40 and the cylinder head 10.

The head cover 30 is provided with intake-side visual observation windows 44 and exhaust-side visual observation windows 46. The intake-side visual observation windows 44 are provided so as to extend in the longitudinal direction of the intake camshaft 26 shown in FIG. 1. The exhaust-side visual observation windows 46 are provided so as to extend in the longitudinal direction of the exhaust camshaft 28 shown in FIG. 1. More specifically, the intake-side visual observation windows 44 and the exhaust-side visual observation windows 46 are designed to satisfy both of the following two conditions.

The first condition is as follows. The intake-side visual observation windows 44 are provided so that, in a state where the head cover 30 has been fixed to the cylinder head 10, it is possible to see, through the intake-side visual observation windows 44, the intake rocker arms 20 (see FIG. 1) or all the intake cams 21 with which the intake camshaft 26 is provided. In addition, the exhaust-side visual observation windows 46 are provided so that, in a state where the head cover 30 has been fixed to the cylinder head 10, it is possible to see, through the exhaust-side visual observation windows 46, the exhaust rocker arms 24 (see FIG. 1) or all the exhaust cams 25 with which the exhaust camshaft 28 is provided. The most characteristic feature of the camshaft support structure of this embodiment is that the head cover 30 is structured so as to satisfy this condition.

In this embodiment, the intake-side visual observation windows 44 and the exhaust-side visual observation windows 46 are designed to make it possible to see both the intake rocker arms 20 through the intake-side visual observation windows 44 and exhaust rocker arms 24 through exhaust-side visual observation windows 46, or both the intake cams 21 through the intake-side visual observation windows 44 and exhaust cams 25 through exhaust-side visual observation windows 46 simultaneously from a single viewpoint. In other words, the intake-side visual observation windows 44 and the exhaust-side visual observation windows 46 are provided so as to make it possible for a worker to see all of the intake rocker arms 20 and the exhaust rocker arms 24, or all of the intake cams 21 and the exhaust cams 25 without changing the worker's position relative to the internal combustion engine (without moving around the engine to the exhaust side thereof) when the worker faces the internal combustion engine from a certain direction (on the intake side of the internal combustion engine, for example) at the assembly line of the internal combustion engine or during maintenance thereof.

The second condition is that the intake-side visual observation windows 44 and the exhaust-side visual observation windows 46 are both opened only in the region in which the windows do not cause the rigidity of the upper bearings 32 to be significantly reduced. When the intake cams push down the intake valves 16, large force as the reaction force is applied to the intake camshaft 26 in the direction of the upper bearings 32. Similarly, when the exhaust cams push down the exhaust valves 18, large force as the reaction force is applied to the exhaust camshaft 28 in the direction of the upper bearings 32.

The reaction force in the direction of the upper bearings 32 is mainly applied to a central area of the semicircular portion 36 (see FIG. 1), that is, the area of the semicircular portion 36 near the top portion thereof. For this reason, in order to ensure the rigidity of the upper bearings 32, it is preferable that the portion (the top portion) be integrated with the head cover 30, that is, at least the top portions of the semicircular portions 36 of adjacent upper bearings 32 be continuous with each other.

That is to say, it is preferable that the intake-side visual observation windows 44 and the exhaust-side visual observation windows 46 be not interposed between the top portions of the semicircular portions 36 of adjacent upper bearings 32. In this embodiment, the intake-side visual observation windows 44 and the exhaust-side visual observation windows 46 are designed so that the above requirements are satisfied, that is, so that none of the windows overlaps the region over the semicircular portion 36, more specifically, the region over the central area of the semicircular portion 36 in FIG. 1 (the region over the central axis of the intake camshaft 26, and the region over the central axis of the exhaust camshaft 28).

Structure of Oil Shower

Referring again to FIG. 1, the structure of an upper portion of the head cover 30 will be described. As shown in FIG. 1, an intake-side oil shower 50 and an exhaust-side oil shower 52 are fixed to the head cover 30 as shown in FIG. 1. In the internal combustion engine, it is necessary to spray oil on the intake cams and the exhaust cams to allow the intake cams and the exhaust cams to smoothly slide on the intake rocker arms 20 and the exhaust rocker arms 24, respectively.

The intake-side oil shower 50 is an element to spray oil on the intake cams through the intake-side visual observation windows 44. The exhaust-side oil shower 52 is an element to spray oil on the exhaust cams through the exhaust-side visual observation windows 46. Both of these showers are fixed to the upper bearings 32 for supporting the intake camshaft 26 and the exhaust camshaft 28.

Basic Structure of Visual Observation Window Cover

As shown in FIG. 1, an intake-side visual observation window cover 54 and an exhaust-side visual observation window cover 56 are fixed to the top of the head cover 30. The intake-side visual observation window cover 54 and the exhaust-side visual observation window cover 56 are both made of magnesium.

The intake-side visual observation window cover 54 is a member to cover the intake-side visual observation windows 44, and is fixed to the head cover 30 so that the intake-side oil shower 50 is housed therein. On the other hand, the exhaust-side visual observation window cover 56 is a member to cover the exhaust-side visual observation windows 46, and is fixed to the head cover 30 so that the exhaust-side oil shower 52 is housed therein.

Oil Filler

The exhaust-side visual observation window cover 56 is provided with an oil filler 58. The oil filler 58 is a supply port used to supply oil to the internal combustion engine. The structure and the shape of the oil filler 58 are designed according to the type of the internal combustion engine, and the model of the vehicle on which the internal combustion engine is mounted, for example, so as to make it possible to smoothly supply oil in a state where the internal combustion engine is mounted on the vehicle.

When the internal combustion engine is actually used, it is sometimes forgotten to close the rid of the oil filler 58 after the oil is supplied. The exhaust-side visual observation window cover 56 is provided with an oil splash prevention structure (not shown) for minimizing the amount of the oil that is splashed out of the internal combustion engine from the oil filler 58 when the internal combustion engine is operated with the lid of the oil filler 58 left open. The structure for effectively preventing oil from being splashed out of the engine is necessarily different depending on the type of the internal combustion engine, and the position in which the internal combustion engine is mounted on the vehicle. For this reason, as in the case of the oil filler 58, the oil splash prevention structure is designed in accordance with the type of the internal combustion engine, and the model of the vehicle on which the internal combustion engine is mounted, for example.

PCV Chamber

In an internal combustion engine, blowby gas can flow out of a cylinder into the inside of the cylinder head 10. On the other hand, oil that is used to lubricate various parts circulates through the cylinder head 10. Accordingly, in order to discharge the blowby gas, it is necessary to provide a separation chamber (hereinafter referred to as "the PCV chamber") for separating the blowby gas and the oil somewhere.

In a typical configuration, the PCV chamber is formed by protruding part of the head cover. In contrast, this embodiment uses the inside of the intake-side visual observation window cover 54 (the concave portion of the intake-side visual observation window cover 54 shown in FIG. 1) and the inside of the exhaust-side visual observation window cover 56 (the concave portion of the exhaust-side visual observation window cover 56 shown in FIG. 1) as the PCV chambers.

Figure 3:
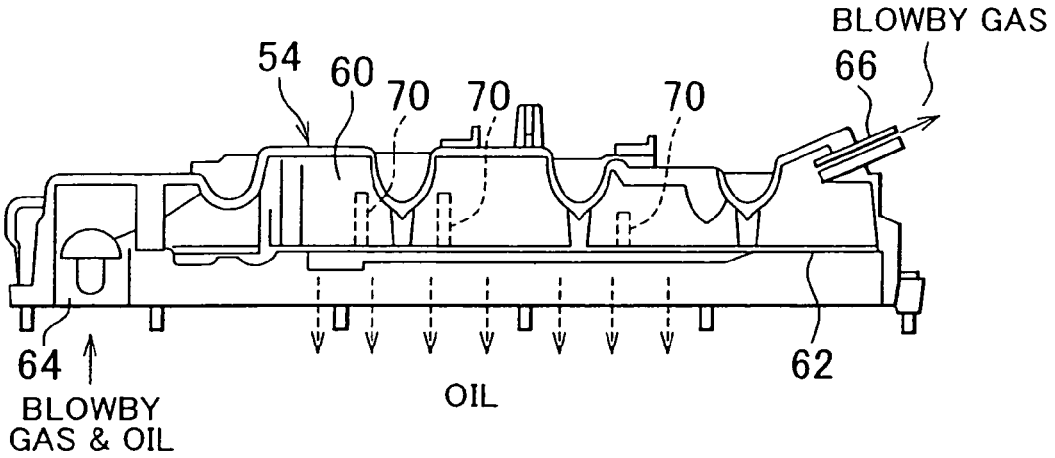
FIG. 3 is a sectional view obtained by cutting an intake-side visual observation window cover shown in FIG. 1 along the longitudinal direction thereof.

FIG. 3 is a sectional view obtained by cutting the intake-side visual observation window cover 54 along the longitudinal direction thereof. As shown in FIG. 3, in the intake-side visual observation window cover 54, a gas/liquid separation chamber 60 is provided, through which the blowby gas that contains oil flows. An oil dripping plate 62 is installed below the gas/liquid separation chamber 60. In one end of the intake-side visual observation window cover 54 (the left end in FIG. 3), a gas inflow region 64 is formed that is not covered by the oil dripping plate 62. In addition, in the other end of the intake-side visual observation window cover 54 (the right end in FIG. 3), a gas outlet hole 66 is provided.

Figure 4:
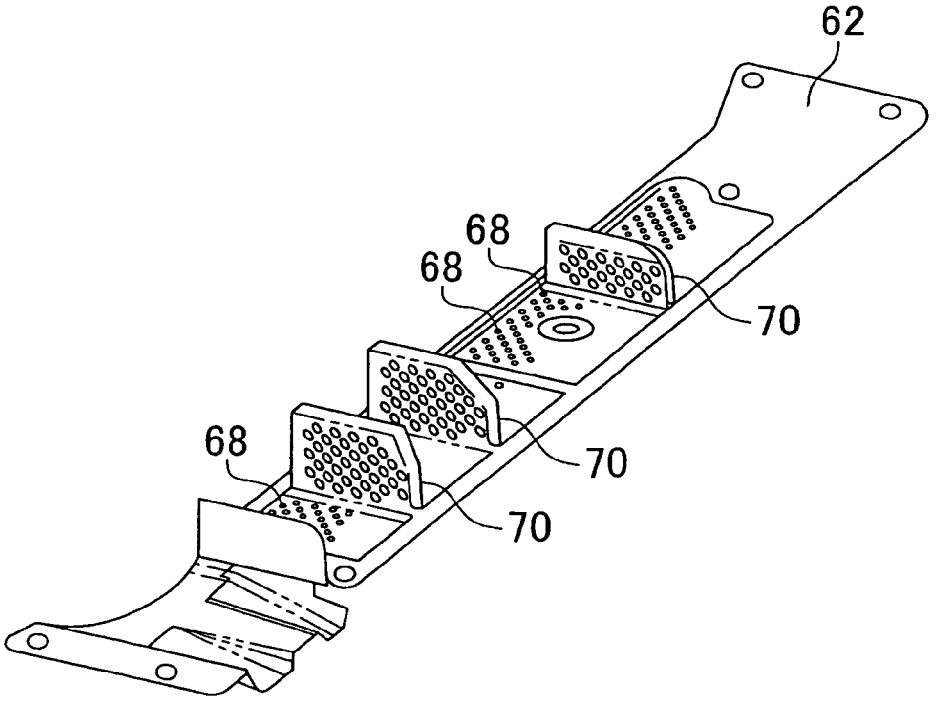
FIG. 4 is a perspective view of an oil dripping plate shown in FIG. 3.

FIG. 4 is a perspective view of the oil dripping plate 62. As shown in FIG. 4, the oil dripping plate 62 is provided with a large number of oil dripping holes 68. The oil dripping plate 62 further includes a plurality of baffle walls 70. The oil dripping holes 68 are also provided in the baffle walls 70.

In the configuration shown in FIG. 3, the blowby gas containing oil primarily flows from the gas inflow region 64 into the intake-side visual observation window cover 54. The inflow gas flows from the gas inflow region 64 into the gas/liquid separation chamber 60, and moves through the gas/liquid separation chamber 60 toward the gas outlet hole 66, in the course of which the flow of the gas is baffled by the baffle walls 70.

As the blowby gas moves through the gas/liquid separation chamber 60, the oil in the gas is trapped by the wall surface of the intake-side visual observation window cover 54 and the oil dripping plate 62. The thus trapped oil is dripped from the oil dripping holes 68, and is again returned into the cylinder head 10 through the intake-side visual observation windows 44. The blowby gas from which the oil therein has been separated is let out through the gas outlet hole 66 for ventilation.

The inside of the exhaust-side visual observation window cover 56 is similarly constructed as the intake-side visual observation window cover 54. Accordingly, with the camshaft support structure of this embodiment, it is possible to efficiently discharge the blowby gas, effectively using the inside of the intake-side visual observation window cover 54 and the inside of the exhaust-side visual observation window cover 56 as the PCV chambers.

(Process of Assembly and Main Effects of First Embodiment)

Figure 5:
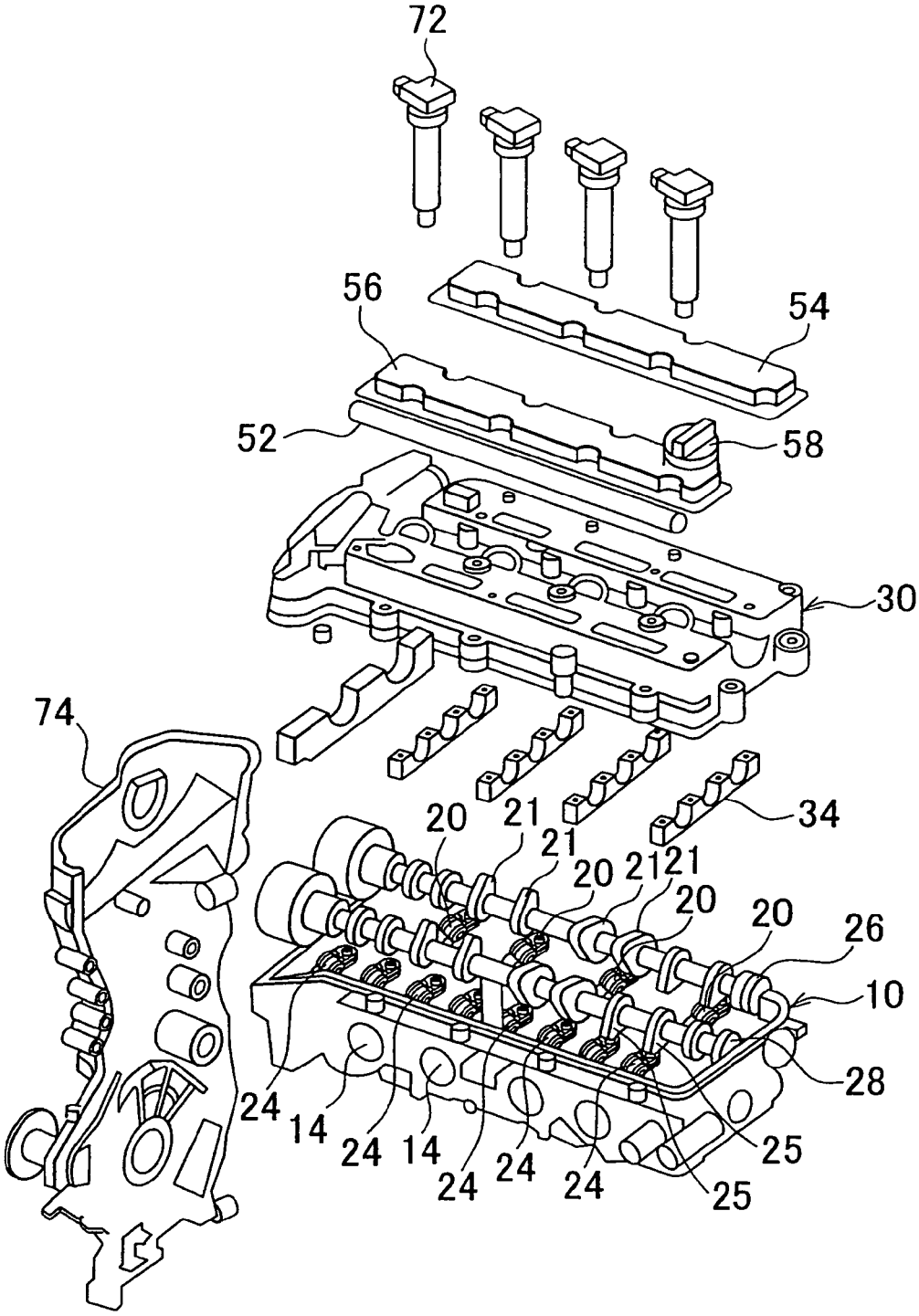
FIG. 5 is an exploded perspective view for explaining a process of assembly of the camshaft support structure of the first embodiment of the present invention.

FIG. 5 is an exploded perspective view for explaining a process of assembly of the camshaft support structure of the first embodiment. In order to assemble the support structure of the first embodiment, first, the cylinder head 10 is fitted with the intake valves 16, the exhaust valves 18, the lash adjusters 22 and others. Subsequently, as shown in FIG. 5, the intake rocker arms 20 and the exhaust rocker arms 24 are placed thereon.

FIG. 5 shows the intake camshaft 26 and the exhaust camshaft 28 placed on the intake rocker arms 20 and the exhaust rocker arms 24, respectively, for convenience. By being fixed in position as shown in FIG. 5, the intake rocker arms 20 and the exhaust rocker arms 24 are brought into a state where the intake rocker arms 20 and the exhaust rocker arms 24 do not fall off the intake valves 16, the exhaust valves 18, and the lash adjusters 22. However, until the intake camshaft 26 and the exhaust camshaft 28 are properly fixed, the intake rocker arms 20 and the exhaust rocker arms 24 are merely placed on the intake valves 16, the exhaust valves 18 and the lash adjusters 22, and are therefore in a state where the intake rocker arms 20 and the exhaust rocker arms 24 can fall off the intake valves 16, the exhaust valves 18 and the lash adjusters 22.

When the support structure of the first embodiment is assembled, the intake camshaft 26 and the exhaust camshaft 28 are held between the upper bearings 32 of the head cover 30 and the lower bearings 34 before being placed on the intake rocker arms 20 and the exhaust rocker arms 24. Specifically, the intake camshaft 26 and the exhaust camshaft 28 are first placed on the predetermined number of lower bearings 34 that are appropriately arranged. The head cover 30 is placed thereover, and then, the head cover 30 and the lower bearings 34 are fastened together. Alternatively, the intake camshaft 26 and the exhaust camshaft 28 are properly placed on the head cover 30 that has been turned upside down. Subsequently, the lower bearings 34 are fixed to the head cover 30 so that the intake camshaft 26 and the exhaust camshaft 28 are properly held.

In the assembly process of the first embodiment, the head cover 30 is placed over the cylinder head 10 so that the intake camshaft 26 and the exhaust camshaft 28 are placed on all of the intake rocker arms 20 and the exhaust rocker arms 24 in a proper positional relationship. In this state, the intake rocker arms 20 and the exhaust rocker arms 24 can fall off, and therefore, it is necessary to perform the operation of placing the head cover 30 on the cylinder head 10 with sufficient care.

In the first embodiment, as described above, the head cover 30 is provided with the intake-side visual observation windows 44 and the exhaust-side visual observation windows 46. Thus, in the process of fixing the head cover 30 to the cylinder head 10, a worker can advance the operation while seeing, through the intake-side visual observation windows 44 and the exhaust-side visual observation windows 46, the intake rocker arms 20 and the exhaust rocker arms 24, or the intake cams 21 and the exhaust cams 25 with which the intake camshaft 26 and the exhaust camshafts 28 are provided, respectively. In addition, the worker can easily check whether all of the intake rocker arms 20 and the exhaust rocker arms 24, or all of the intake cams 21 and the exhaust cams 25 are in a proper state through the intake-side visual observation windows 44 and the exhaust-side visual observation windows 46 after finishing the operation of placing the head cover 30 on the cylinder head 10.

Especially, in the first embodiment, the intake-side visual observation windows 44 and the exhaust-side visual observation windows 46 are configured so as to make it possible to see both the intake rocker arms 20 through the intake-side visual observation windows 44 and the exhaust rocker arms 24 through the exhaust-side visual observation windows 46, or both the intake cams 21 through the intake-side visual observation windows 44 and the exhaust cams 25 through the exhaust-side observation windows 46 simultaneously from a single viewpoint. Thus, during the process of fixing the head cover 30 to the cylinder head 10, a single worker can easily perform the assembly and the check after the assembly while seeing the intake rocker arms 20 and the exhaust rocker arms 24, or the intake cams 21 and the exhaust cams 25.

For the above reason, with the support structure of the first embodiment, the construction in which the upper bearings 32 are integrated with the head cover 30 is used, and, at the same time, it is possible to effectively prevent troubles, such as the falling off of the intake rocker arms 20 and the exhaust rocker arms 24, and to effectively prevent such troubles from being overlooked during the assembly process. Accordingly, with the support structure of the first embodiment, it is possible to realize excellent productivity using the head cover 30 with which the upper bearings 32 are integrated.

The intake-side oil shower 50 and the exhaust-side oil shower 52 are installed in the head cover 30. Subsequently, the intake-side visual observation window cover 54 and the exhaust-side visual observation window cover 56 are fixed to the head cover 30 so that the intake-side oil shower 50 and the exhaust-side oil shower 52 are housed therein. These operations may be performed before or after the head cover 30 is fixed to the cylinder head 10. However, if the operation of fixing the head cover 30 to the cylinder head 10 is performed before the intake-side visual observation window cover 54 and the exhaust-side visual observation window cover 56 are fixed to the head cover 30, it is made possible for a single worker to easily perform the assembly while seeing the intake rocker arms 20 and the exhaust rocker arms 24, or the intake cams 21 and the exhaust cams 25.

After the above process is completed, an ignition plug unit 72 is installed for each of the cylinders from above the head cover 30. In addition, a chain case 74 is mounted on a side face of the cylinder head 10 and the head cover 30.

Other Effects

With the camshaft support structure of the first embodiment, even after the internal combustion engine has been assembled, it is easily made possible to see the intake rocker arms 20 and the exhaust rocker arms 24, or the intake cams 21 and the exhaust cams 25 by removing the intake-side visual observation window cover 54 and the exhaust-side visual observation window cover 56. The visual observation of the intake rocker arms 20 and the exhaust rocker arms 24, or of the intake cams 21 and the exhaust cams 25 may be required at the time of maintenance/inspection of the internal combustion engine even after the vehicle is shipped. With the structure of the first embodiment, it is made possible to easily respond to such a demand. Accordingly, with the camshaft support structure of the first embodiment, it is made possible to achieve better workability of the maintenance/inspection of the internal combustion engine.

As described above, with the camshaft support structure of the first embodiment, the upper bearings 32 are such that at least the top portions of the semicircular portions 36 of adjacent upper bearings 32 are continuous with each other. Thus, with the structure of the first embodiment, while the head cover 30 is provided with the intake-side visual observation windows 44 and the exhaust-side visual observation windows 46, and magnesium, which has lower rigidity than aluminum and cast iron, is used as the material of the head cover 30, it is possible to give sufficient rigidity to the upper bearings 32.

In addition, in the camshaft support structure of the first embodiment, the head cover 30, the lower bearings 34, the intake-side visual observation window cover 54, and the exhaust-side visual observation window cover 56 are made of magnesium. As compared to the case where these members are made of aluminum or cast iron, the weight of these members is significantly reduced if they are made of magnesium. Accordingly, with the camshaft support structure of the first embodiment, it is possible to significantly reduce the weight of the internal combustion engine, and to lower the center of gravity of the internal combustion engine.

With the camshaft support structure of the first embodiment, the intake-side oil shower 50 and the exhaust-side oil shower 52 are directly fixed to the upper bearings 32. Such a structure makes it possible to sufficiently reduce the distance between the intake-side oil showers 50 and the intake cams 21 or the distance between the exhaust-side oil showers 52 and the exhaust cams 25. In addition, in this case, the positional relationship therebetween is determined by the accuracy of the upper bearings 32. Accordingly, with this structure, it is possible to improve the accuracy of spraying oil by the intake-side oil showers 50 and the exhaust-side oil showers 52.

With the above-described camshaft support structure, it is possible to easily carry out the maintenance/inspection of the intake-side oil shower 50 and the exhaust-side oil shower 52 immediately after removing the intake-side visual observation window cover 54 and the exhaust-side visual observation window cover 56. Thus, the camshaft support structure of the first embodiment also makes it possible to achieve better workability of the maintenance/inspection of the intake-side oil shower 50 and the exhaust-side oil shower 52.

As described above, in the camshaft support structure of the first embodiment, the oil filler 58 and the oil splash prevention structure are provided in the exhaust-side visual observation window cover 56 instead of the head cover 30. As described above, the oil filler 58 and the oil splash prevention structure sometimes require different design depending on the type of the internal combustion engine, the model of the vehicle on which the internal combustion engine is mounted, etc. With the structure of the first embodiment, it is possible to respond to the demand by modifying the exhaust-side visual observation window cover 56 only, without making any changes in the cylinder head 30, for example. Thus, it is possible to enhance the commonality of components, such as the cylinder head 30.

As described above, in the camshaft support structure of the first embodiment, the PCV chambers are provided in the intake-side visual observation window cover 54 and the exhaust-side visual observation window cover 56. Thus, with this structure, it is possible to simplify the construction of the head cover 30, and to improve the productivity in manufacturing the internal combustion engine as a whole. In addition, with this structure, it is possible to change the specifications of the PCV chamber by altering the intake-side visual observation window cover 54 and the exhaust-side visual observation window cover 56. The specifications of the PCV chamber vary depending on the vehicle model because of constraints such as available space in the engine compartment. With the structure of the first embodiment, it is possible to appropriately respond to such a demand by altering the intake-side visual observation window cover 54 and the exhaust-side visual observation window cover 56. Also from this viewpoint, with the camshaft support structure of the first embodiment, it is possible to enhance the commonality of components, such as the head cover 30.

(Modified Examples of First Embodiment)

Although, in the above-described first embodiment, all the upper bearings 32 are such that at least the top portions of the semicircular portions 36 of adjacent upper bearings 32 are continuous with each other, the present embodiment is not limited to this configuration. Specifically, part of the upper bearings 32 may be such that the top portion of the semicircular portion 36 of the upper bearing 32 is not continuous with that of the adjacent upper bearing 32.

Although, in the above-described first embodiment, the PCV chambers are formed in the intake-side visual observation window cover 54 and the exhaust-side visual observation window cover 56 by disposing the oil dripping plates 62 therein, the method of forming the PCV chambers is not limited thereto. For example, the PCV chamber may be formed by fixing the intake-side visual observation window cover 54 and the exhaust-side visual observation window cover 56 to the head cover 30 without the oil dripping plate 62.

Although, in the above-described first embodiment, the head cover 30, the lower bearings 34, the intake-side visual observation window cover 54, and the exhaust-side visual observation window cover 56 are made of magnesium, the material thereof is not limited to magnesium. These members may be made of the material such as magnesium alloy or resin composite, that is lighter than aluminum and cast iron. Otherwise, these members may be made of aluminum or cast iron as in the case of the cylinder head 10.

In the above-described first embodiment, it is supposed that the intake rocker arms 20 and the exhaust rocker arms 24 can fall off the intake valves 16, the exhaust valves 18 and the lash adjusters 22 until the installation of the intake camshaft 26 and the exhaust camshaft 28 is completed. However, the present embodiment is not premised on such a construction. Specifically, the present embodiment may be such that there is no fear that the intake rocker arms 20 and the exhaust rocker arms 24 fall off, owing to these arms being held by the rocker-arm shafts. Also in this case, the support structure in which the head cover 30 has the intake-side visual observation windows 44 and the exhaust-side visual observation windows 46 at least makes it possible to obtain an effect that the workability of the maintenance/inspection carried out after the shipment of the vehicle is improved.

Although, in the above-described first embodiment, the separate lower bearings 34 are used, the present embodiment is not limited to this construction. Specifically, in the embodiment, a ladder frame type lower bearing may be used, in which a plurality of lower bearings 34 are connected in a ladder shape.

In the above-described first embodiment, the intake-side visual observation windows 44 and the exhaust-side visual observation windows 46 are provided such that at least the top portions of the semicircular portions 36 of adjacent upper bearings 32 are continuous with each other. However, this condition (the above-described second condition) can be paraphrased as follows. In the first embodiment, the top portion of the semicircular portion 36 is the portion to which the reaction force is most strongly applied that is produced when the intake valve 16 or the exhaust valve 18 is opened. Accordingly, this condition is that the intake-side visual observation windows 44 and the exhaust-side visual observation windows 46 are provided such that the portions of adjacent upper bearings 32 to which the reaction force is most strongly applied that is produced when the valve is opened are continuous with each other.

Although the above embodiments have been described with the intake rocker arms 20, the intake cams, the exhaust rocker arms 24 and the exhaust cams cited as the valve system parts, the valve system parts are not limited to these parts.

The invention claimed is:

1. A camshaft support structure for an internal combustion engine, comprising:

a cylinder head;

a camshaft provided with a cam for driving a valve element, the camshaft having an upper bearing side, a lower bearing side, and a journal portion;

a lower bearing that supports the lower bearing side of the camshaft, the lower bearing side of the camshaft being closer to the cylinder head than the upper bearing side of the camshaft, the upper bearing side being opposite to the lower bearing side;

a rocker arm that is installed in the cylinder head; and a head cover that is integrally provided with an upper bearing that supports the upper bearing side of the camshaft, and is provided with a visual observation window so that at least one of the rocker arm and the cam is viewable in a state where the head cover is fixed to the cylinder head, the upper bearing being a plurality of upper bearings, wherein each of the plurality of upper bearings has a semicircular portion to hold the journal portion of the camshaft, and at least part of the plurality of upper bearings are such that a top portion of the semicircular portion of one of the plurality of upper bearings is continuous with a top portion of the semicircular portion of an adjacent one of the plurality of upper bearings.

2. The camshaft support structure for an internal combustion engine according to claim 1, wherein the camshaft is a plurality of camshafts that include an intake camshaft provided with an intake cam for driving an intake valve, and an exhaust camshaft provided with an exhaust cam for driving an exhaust valve;

the rocker arm is a plurality of rocker arms that include an intake rocker arm that is in contact with the intake cam, and an exhaust rocker arm that is in contact with the exhaust cam;

the visual observation window is a plurality of visual observation windows that include an intake-side visual observation window and an exhaust-side visual observation window whereby the intake rocker arm is viewable through the intake-side visual observation window and the exhaust rocker arm is viewable through the exhaust-side visual observation window; and the intake-side visual observation window and the exhaust-side visual observation window are provided so that the intake rocker arm and the exhaust rocker arm are both viewable from a single viewpoint through the respective intake-side visual observation window and the exhaust-side visual observation window when the internal combustion engine is viewed from the single viewpoint.

3. The camshaft support structure for an internal combustion engine according to claim 1, wherein the camshaft is a plurality of camshafts that include an intake camshaft provided with an intake cam for driving an intake valve, and an exhaust camshaft provided with an exhaust cam for driving an exhaust valve;

the visual observation window is a plurality of visual observation windows that include an intake-side visual observation window and an exhaust-side visual observation window whereby the intake cam is viewable through the intake-side visual observation window and the exhaust cam is viewable through the exhaust-side visual observation window: and the intake-side visual observation window and the exhaust-side visual observation window are provided so that the intake cam and the exhaust cam are both viewable from a single viewpoint through the respective intake-side visual observation window and the exhaust-side visual observation window when the internal combustion engine is viewed from the single viewpoint.

4. The camshaft support structure for an internal combustion engine according to claim 3, wherein the plurality of visual observation windows are provided so that all of the cams with which the internal combustion engine is provided are viewable.

5. The camshaft support structure for an internal combustion engine according to claim 1, wherein the head cover is provided with the plurality of upper bearings that are arranged in an axial direction of the camshaft, and at least part of the plurality of upper bearings are such that at least a portion of the upper bearing to which reaction force is most strongly applied that is produced when the valve element is opened is continuous with an adjacent upper bearing.

6. The camshaft support structure for an internal combustion engine according to claim 1, wherein each of the plurality of upper bearings has the semicircular portion for holding the journal portion of the camshaft, and at least the part of the plurality of upper bearings are such that at least the top portion of the semicircular portion of the one upper bearing is continuous with the top portion of the semicircular portion of the adjacent one upper bearing.

7. The camshaft support structure for an internal combustion engine according to claim 6, wherein all of the plurality of upper bearings are such that at least the top portion of the semicircular portion of an upper bearing is continuous with the top portion of the semicircular portion of every adjacent upper bearing.

8. The camshaft support structure for an internal combustion engine according to claim 1, further comprising a visual observation window cover, separate from the head cover, that covers the visual observation window.

9. The camshaft support structure for an internal combustion engine according to claim 8, wherein a separation chamber for separating oil and gas that are discharged through the visual observation window is formed inside the visual observation window cover.

10. The camshaft support structure for an internal combustion engine according to claim 8, wherein the visual observation window cover is made of a lightweight material that is lighter than a material of the cylinder head.

11. The camshaft support structure for an internal combustion engine according to claim 10, wherein the material of which the visual observation window cover is made includes at least one of magnesium, magnesium alloy and resin composite.

12. The camshaft support structure for an internal combustion engine according to claim 8, further comprising:

an oil shower, disposed between the upper bearing and the visual observation window cover, that sprays oil on the cam or the rocker arm through the visual observation window.

13. The camshaft support structure for an internal combustion engine according to claim 12, wherein the oil shower is directly fixed to the upper bearing.

14. The camshaft support structure for an internal combustion engine according to claim 8, further comprising:

an oil filler used to supply oil to the internal combustion engine; and an oil splash prevention structure for blocking oil that splashes from an inner area in the internal combustion engine toward the oil filler, wherein the oil filler and the oil splash prevention structure are provided in the visual observation window cover.

15. The camshaft support structure for an internal combustion engine according to claim 1, wherein the camshaft has a central axis, and the top portion of the semicircular portion of the one of the plurality of upper bearings is continuous with the top portion of the semicircular portion of the adjacent one of the plurality of upper bearings such that the visual observation window is not interposed between the one and adjacent one of the plurality of upper bearings at a location above the central axis of the camshaft.

* * * * *